US008909034B2

(12) United States Patent
Colasson et al.

(10) Patent No.: US 8,909,034 B2
(45) **Date of Patent: *Dec. 9, 2014**

(54) RADIATOR FOR DOMESTIC HEATING WITH A TWO-PHASE HEAT-TRANSFER FLUID

(75) Inventors: Stephane Colasson, Voreppe (FR); Alain Marechal, Tullins (FR)

(73) Assignee: Commissariat a l'Energie Atomique et aux Energies Alternatives (FR)

( * ) Notice: Subject to any disclaimer, the term of this patent is extended or adjusted under 35 U.S.C. 154(b) by 0 days.

This patent is subject to a terminal disclaimer.

(21) Appl. No.: 13/174,117

(22) Filed: Jun. 30, 2011

(65) Prior Publication Data

US 2012/0002954 A1 Jan. 5, 2012

Related U.S. Application Data

(63) Continuation of application No. PCT/FR2009/052703, filed on Dec. 28, 2009.

(30) Foreign Application Priority Data

Jan. 19, 2009 (FR) ..... 09 50302

(51) Int. Cl.

| | |
|---|---|
| ***H05B 3/02*** | (2006.01) |
| ***F24H 3/00*** | (2006.01) |
| ***F28D 1/02*** | (2006.01) |
| ***F28D 1/053*** | (2006.01) |
| ***F28D 15/02*** | (2006.01) |

(52) U.S. Cl.

CPC ..... *F24H 3/004* (2013.01); *F28D 1/0226* (2013.01); *F28D 1/05308* (2013.01); *F28D 15/0275* (2013.01)

USPC ..... 392/357; 392/347; 392/342; 392/344

(58) Field of Classification Search

USPC ..... 252/71, 75; 392/341–346, 347, 352, 392/442, 444, 302, 357, 377, 378

See application file for complete search history.

(56) References Cited

U.S. PATENT DOCUMENTS 1,852,252 A * 4/1932 McIntosh ..... 237/16
3,521,707 A * 7/1970 Brown ..... 165/152

(Continued)

FOREIGN PATENT DOCUMENTS

EP 0281401 A2 9/1988
EP 0834715 A2 4/1998

(Continued)

OTHER PUBLICATIONS

International Search Report and Written Opinion of the International Searching Authority; PCT/FR2009/052703; Mar. 15, 2010; 8 pages.

*Primary Examiner* — Dana Ross
*Assistant Examiner* — James Sims, III
(74) *Attorney, Agent, or Firm* — St. Onge Steward Johnston & Reens LLC

(57) ABSTRACT

A radiator for domestic heating with a heat-transfer fluid operating in two-phase form includes a reservoir of the heat-transfer fluid; a hot source, intended to raise the temperature of the heat-transfer fluid to a temperature such that it causes said fluid to undergo a change of phase; and a heater, at which the heat transfer with ambient air takes place, having n channels, communicating in a lower zone with the reservoir, it being possible for n to be equal to 1. The heat-transfer fluid is a mixture of at least two different heat-transfer liquids, the heat-transfer liquids having between them boiling points differing by at least ten degrees Celsius, and the liquid with the lowest boiling point representing 70% to 95% of the volume of the mixture for a mixture temperature of about 20° C.

14 Claims, 2 Drawing Sheets

(56) References Cited

U.S. PATENT DOCUMENTS

| | | | | | |
|---|---|---|---|---|---|
| 4,518,847 | A | * | 5/1985 | Horst et al. | 392/358 |
| 4,969,512 | A | * | 11/1990 | Hisao et al. | 165/153 |
| 5,540,278 | A | * | 7/1996 | Chiba et al. | 165/175 |
| 5,966,498 | A | * | 10/1999 | Kirchner et al. | 392/357 |

FOREIGN PATENT DOCUMENTS

| | | | | | |
|---|---|---|---|---|---|
| GB | 2099980 | A | | 12/1982 | |
| WO | WO0070289 | | * | 11/2000 | C23C 30/00 |
| WO | 0250479 | A1 | | 6/2002 | |
| WO | WO2007/099055 | | * | 9/2007 | C09K 5/10 |

* cited by examiner

RADIATOR FOR DOMESTIC HEATING WITH A TWO-PHASE HEAT-TRANSFER FLUID

CROSS-REFERENCE TO RELATED APPLICATIONS

The present application is a continuation of pending International patent application PCT/FR2009/052703 filed on Dec. 28, 2009 which designates the United States and claims priority from French patent application FR 0950302 filed on Jan. 19, 2009, the content of which is incorporated herein by reference.

FIELD OF THE INVENTION

The invention relates to a radiator more specifically intended for domestic heating, and operating by means of a heat-transfer fluid. More specifically, the heat-transfer fluid used in the inventive radiator operates in two-phase and particularly liquid/vapour form.

BACKGROUND OF THE INVENTION

There are basically two known different types of domestic electric radiator. Firstly, electric convectors, for which the ambient air to be heated is directly in contact with an electrical heating resistance. These electric convectors are in widespread use but have the drawback of generating a significant movement of the ambient air because of the temperature gradient created, causing a feeling of discomfort for the occupants of the room under consideration. This problem is partially resolved by another type of so-called radiant radiator operating by radiation.

Also known are radiators with a heat-transfer fluid, wherein said fluid, generally oil, is heated by means of an electric heating element and is conveyed in a heater, in which the heat is transferred to the ambient air by natural convection. Given the presence of a heater with a relatively large heat transfer surface, the temperature gradient with the ambient air is reduced so that the movements of air by natural convection in the room concerned are limited.

Among these radiators with a heat-transfer fluid may be distinguished firstly radiators in which the fluid operates in single-phase. In the case in point, said fluid remains in the liquid state. In this case, the heat-transfer fluid is heated in contact with an electric heating element, thins out and rises inside the heater. As it moves gradually upward, the heat-transfer fluid gives up some of the heat to the ambient air through the wall of the heater, and consequently cools down. Since the fluid so cooled becomes denser, and therefore heavier, it drops back down by gravity into the lower part of the radiator. To operate this type of radiator properly, it therefore proves necessary to have a minimum temperature difference between the rising (hot) fluid and the dropping (cold) fluid that is directly dependent on the fluid pressure drops generated by its circulation. This type of radiator thus sees a non homogeneous distribution of the temperature of the heater wall, that affects the efficiency of the radiator. Moreover, this type of operation may induce hot points on the surface of the appliance that are dangerous and additionally incompatible with decreed safety standards.

To overcome these drawbacks, a radiator with a heat-transfer fluid has been proposed, for example in the documents GB-A-2 099 980 and WO-A-02/50479 that operates in two-phase form, and particularly liquid/vapour. Said radiator operates as follows: The heat-transfer fluid in the liquid state lies through gravity in the lower part of the radiator passed through by a heating element, constituted by a temperature raised fluid, and passing through the base of said radiator in a leak-tight manner.

Under the effect of the heat, the heat-transfer fluid is vaporized, said vapour then rising in the internal structure of the radiator, and particularly in a heater, in which a transfer of heat occurs. Consequently, because of the temperature of the walls of said heater, lower than that of the vapour, the latter condenses. The condensate so formed comes in liquid form, and returns by gravity alone to the lower part of the radiator.

Because of the heat transfer method, in the case in point by phase change, bringing the latent condensation heat directly into play, an almost homogeneous heater wall temperature is thus ensured, thereby constituting a very clear improvement relative to radiators with a heat-transfer fluid that operate in single-phase. Indeed, this transfer temperature is very close to the saturating vapour temperature of the heat-transfer fluid because of a heat exchange factor that is appreciably higher in condensation than by natural convection on the outside, i.e. on the ambient air side. A substantial gain is thus obtained in respect of the variation in air temperature.

However, the hot source raising the temperature of the heat-transfer fluid proves tricky to control, both in time and in space. Moreover, it can be seen that if the vaporization rate of the heat-transfer fluid is too high, the vapour so generated produces drops of heat-transfer fluid, disturbing the proper operation of the radiator.

Moreover, with two-phase radiators of this kind, a noise problem is encountered too when they start up. This noise is caused by pressure waves when the vapour bubbles collapse in the sub-cooled liquid. Depending on the fluid used and the quantity of liquid fluid introduced into the body of the radiator, this noise phenomenon is more or less significant. In fact, this noise pollution may prove bothersome, or even totally unacceptable for some uses, such as in particular hospital wards, convalescent homes, retirement homes, or even just bedrooms.

Furthermore, when the heating element is directly in contact with the heat-transfer fluid for the heating thereof, as is the case for example in the document WO-A-02/50479, it may be damaged when the volume of liquid is too small. Indeed, the vapour phase, in which the heating element is for the most part, if not entirely, soaked, is not sufficient to absorb the energy of the heating element which may then overheat.

Additionally, using a radiator with a heat-transfer fluid operating in two-phase form means that it has to be mechanically strong because of the pressure exerted on the walls by the vapour which is under pressure given the enclosed space in which it is trapped. This generally means that the radiator has to be oversized and/or thick walls used thereby taking up space and involving extra cost.

A two-phase fluid has also been proposed in the document EP 0 281 401, wherein said fluid is constituted by two different heat-transfer liquids, in the case in point glycol ethylene and water.

SUMMARY OF THE INVENTION

The purpose of this invention is to resolve the problem of heating element overheating and maximum acceptable pressure by the radiator.

To this end, the invention relates to a radiator for domestic heating with a heat-transfer fluid operating in two-phase form, said heat-transfer fluid being constituted by a mixture of at least two different heat-transfer liquids comprising:

a reservoir of said heat-transfer fluid;

a hot source, intended to raise the temperature of said heat-transfer fluid to a temperature such that it causes said fluid to undergo a change of phase;

a heater at which the heat transfer with the ambient air takes place, having n channels, communicating in a lower zone with the reservoir, it being possible for n to be equal to 1.

According to the invention, the heat-transfer liquids have between them boiling points differing by at least ten degrees Celsius, and the liquid with the lowest boiling point represents 70% to 95% of the volume of the mixture for a mixture temperature of about 20° C.

Preferably, the at least two heat-transfer liquids are miscible with each other.

Put another way, the vapour formation phase is implemented in at least two consecutive steps as the temperature of the heating element increases. The presence of the heat-transfer liquid with the higher boiling point, also signifying a denser and less volatile liquid, ensures that a minimum level of liquid is present in the radiator header, thereby avoiding a drying effect in the heating element.

It is further observed that for one and the same volume of heat-transfer fluid, the pressure of the vapour in the radiator when the heating element is operating at full power is less with two heat-transfer liquids of different boiling points than with a single heat-transfer liquid, which therefore leaves more freedom when choosing the dimensions of the radiator and of walls thereof.

According to the invention, the heat-transfer fluid may be a mixture of at least two types of fluorinated or hydrofluorinated aliphatic chains, and particularly hydrofluoroethers.

According to one inventive embodiment, the heat-transfer fluid comprises two different heat-transfer liquids, the first liquid being methoxy-nonafluorobutane, and the second liquid being decafluoro-3-methoxy-4-trifluoro-methylpentane, and in that the heat-transfer liquid with the lower boiling point constitutes around 95% of the volume of the mixture for a mixture temperature equal to 20° C.

According to another inventive embodiment, the heat-transfer fluid is a mixture of three different heat-transfer liquids, the first liquid being methoxy-nonafluorobutane, the second liquid being decafluoro-3-methoxy-4-trifluoro-methylpentane, and the third liquid being a product satisfying the formula $HF_2C—(OC_2F_4)_m—(OCF_2)_n—OCF_2H$, wherein m and n are natural numbers with $0 \le m \le 3$ and $0 \le n \le 3$, and to advantage ZT-130®, and the first, second and third liquids represent about 85%, 10% and 5% respectively of the volume of the mixture for a mixture temperature equal to 20° C.

According to one particular embodiment, the cross-section S of the connection between the reservoir of the heat-transfer fluid, located in the lower part of said radiator and the heater, able to have a plurality n of channels, it being possible for n to be equal to 1, is greater than or equal to the expression:

$$\frac{A \times P^{\frac{4}{5}}}{n},$$

an expression wherein:

P denotes the power of the electrical resistance;

n is, as already stated, the number of channels constituting the heater;

and A is a constant dependent on the nature of the fluid and on the temperature thereof (A is expressed as $m^2 \cdot W^{-4/5}$).

It may thus be observed that, first of all, using an electrical resistance of this kind as hot source for the heat-transfer fluid allows the general operation of the radiator to be controlled much more easily, in time and in space.

Moreover, making connection zones with a passage between the reservoir and the channels constituting the heater that respect the aforementioned relation, eliminates or at the very least drastically reduces the number of drops of the heat-transfer fluid in liquid form produced by the vapour generated in the hot source, and consequently optimizes the operation of the radiator.

Since the overheating of the heat-transfer fluid in liquid form in the reservoir is controlled, any noise generated by the collapse of the vapour bubbles is reduced.

To advantage, the connection zone of the channels constituting the heater at the reservoir emerges above the electrical resistance.

In order to optimize the operation of the inventive radiator, the connection zones of the heater channels at the reservoir have their lower part at a minimum distance δ above the upper tangency line of the electrical heating resistance passing through the reservoir, said distance respecting the relation $\delta \ge 0.5 \times D$, wherein D is the diameter of said heating resistance.

In order to optimize the operation of the inventive radiator, particularly in terms of reducing noise at start-up, the filling factor α must be greater than the value 0.0142, said factor α being defined by the ratio of the vapour mass produced at 20° C. to the total fluid mass introduced into the body of the radiator.

BRIEF DESCRIPTION OF THE DRAWINGS

The manner in which the invention may be implemented and the resulting advantages will become clearer from the following embodiment example, given by way of information and non-restrictively, supported by the appended figures.

DETAILED DESCRIPTION OF THE INVENTION

Figure 1:
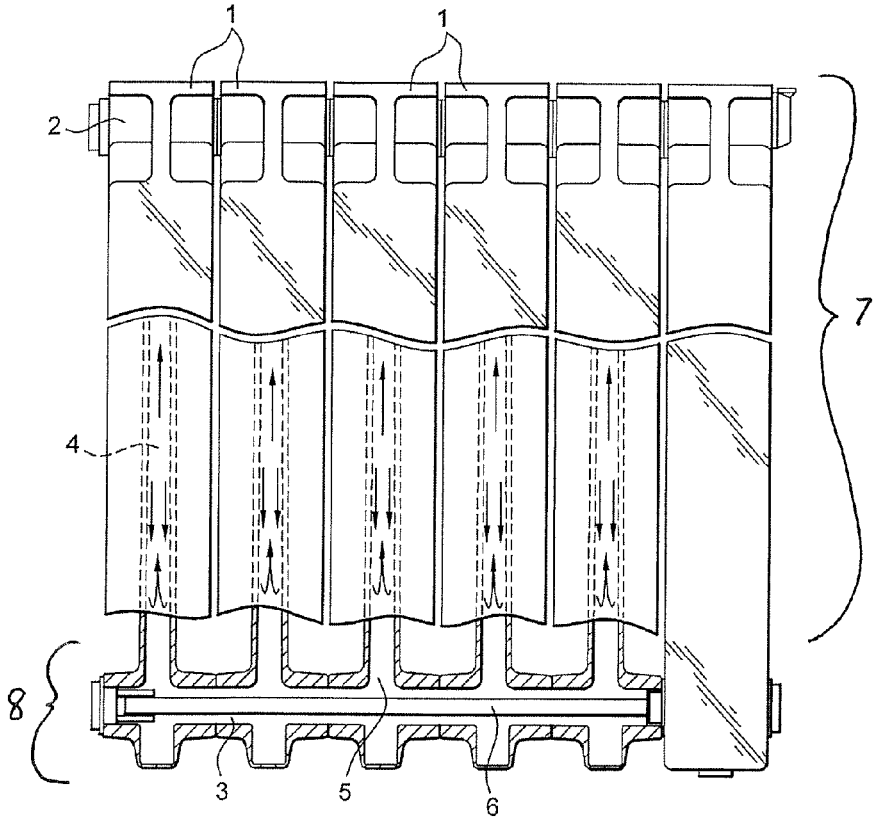
FIG. 1 is a partially exploded diagrammatic representation of a radiator with a known heat-transfer fluid.

A radiator with a heat-transfer fluid known per se has been shown in relation to FIG. 1. This radiator is in the case in point constituted by a plurality of unitary elements 1, constituting the heater 7, all the elements being connected to a lower reservoir 3.

These different elements 1 may, for example, be made of die-cast aluminium and, in order to optimize the transfer with the ambient air are able to have fins 2 thereby promoting heat diffusion within the room in which said radiator is installed.

In each of these elements 1 there flows a heat-transfer fluid, the nature thereof being appropriate to the intended thermal function. This fluid may be water, ethanol, or a synthetic polymer material, such as for example R113 (chlorofluorocarbon), or a fluorinated, or hydrofluorinated, aliphatic chain, and preferentially a hydrofluoroether (such as HFE 7100®, HFE 7300® or HFE 7500®, marketed by 3M, or again ZT-150®, ZT-130® or ZT-85® marketed by the Solvay-Solexis company).

Hydrofluoroether is taken to mean mainly a family of molecules that satisfy the following structure I:

$$A\text{-}O\text{-}(B\text{-}O)_m\text{-}(C\text{-}O)_n\text{-}D \qquad (I)$$

wherein A, B, C and D represent linear or ramified aliphatic groups comprising between 1 and 10 atoms of carbon, with the hydrogens thereof being totally or partially replaced by atoms of fluorine, and wherein m and n are natural numbers with $0 \leq m \leq 3$ and $0 \leq n \leq 3$.

Preferentially, the aforementioned aliphatic groups are alkyl groups.

HFE 7100® is thus a mixture of 1-methoxy-nonafluorobutane and 1-methoxy-nonafluorotertiobutane, and HFE 7300® is decafluoro-3-methoxy-4-trifluoro-methylpentane.

The aforementioned ZT products are hydrofluoroethers that satisfy the following general formula II:

$$HF_2C—(OC_2F_4)_m—(OCF_2)_n—OCF_2H \quad \text{(II)}$$

wherein m and n are natural numbers with $0 \leq m \leq 3$ and $0 \leq n \leq 3$.

The different elements 1 are put together to form the actual heater 7, and are each fitted with a vertical channel 4, emerging in a lower zone 8 in the reservoir 3 via a connection zone 5.

Figure 2:
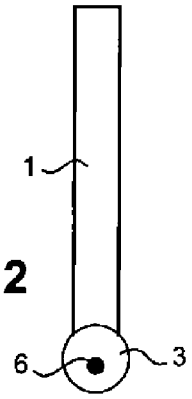
FIG. 2 shows a view in transverse cross-section of such a radiator, but in compliance with the invention.

As may clearly be seen in FIG. 2, an electrical heating element 6 is inserted into the lower reservoir 3 and passes through it over substantially its entire length. Such a resistance may for example be constituted by a double-insulated cartridge heater.

According to one inventive feature, the connection zone 5 between the channel or channels 4 of the heater and the reservoir 3 located in the lower part of said radiator has a cross-section S satisfying the following formula:

$$S \geq \frac{AP^{\frac{4}{5}}}{n}$$

As already stated above:

P stands for the power of the electrical resistance 6;

n is the number of channels 4 and therefore the number of elements 1 constituting the heater emerging in the same reservoir 3;

A is a constant, dependent on the nature of the fluid measured at a given temperature.

The constant A derives from the use of a flow model for liquid droplets produced by a vapour flux, such as the Wallis and Kutateladze model. The model in the context of this invention is modified to take account of the injected thermal power, which expressed directly in the use of the term "source" for the vapour flux production in the channels constituting the radiator. In these conditions, the constant A satisfies the following formula:

$$A = \frac{10^4}{\left[\left(\frac{4}{\pi}\right)^{0,5} K\right]^{\frac{4}{5}}}$$

a formula wherein K is a function of the physical properties of the fluid and is expressed as follows:

$$K = 0,435 h_{lv}\left[\frac{\sqrt{g(\rho_l - \rho_v)}}{\left(\sqrt{\frac{0,5}{\rho_v^{0,5}}} + 0,5\sqrt{\frac{0,5}{\rho_l^{0,5}}}\right)^2}\right]$$

where $h_{lv}$ is the latent vaporization heat of the fluid and ρ the density (liquid or vapour).

Where mixtures are concerned, the physical properties are calculated from those of the constituents of the mixture by adopting the recognized mixture laws.

Experience shows that the most restricting conditions in relation to the heat-transfer fluid appear when the latter is at a temperature close to 20° C., i.e. at start-up of the radiator presumed initially to be at room temperature.

In these operating conditions, the constant A has the value, when the heat-transfer fluid is constituted by only one of the following elements:

| | |
|---|---|
| for water | A = 0.0106; |
| for ethanol | A = 0.0125; |
| for HFE 7100 ® | A = 0.0153; |
| for HFE 7300 ® | A = 0.0173; |
| for HFE 7500 ® | A = 0.0193; |
| for ZT-150 ® | A = 0.024; |
| for ZT-130 ® | A = 0.0193; |
| for ZT-85 ® | A = 0.0187; |
| for R113 | A = 0.0117. |

For digital use, for a radiator, whereof the heat-transfer fluid is water, developing 1.000 watts electric, and comprising ten elements 1, therefore ten channels 4 in parallel, the cross-section of the connection 5 between each of the channels and the reservoir 3 must be more than 0.27 $cm^2$.

Conversely, for an organic fluid such as HFE 7100 and in the same configuration, the cross-section of the connection zone 5 must be more than or equal to 0.383 $cm^2$.

Figure 3:
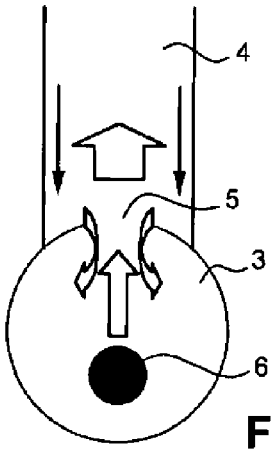
FIG. 3 is a detailed diagrammatic representation of the transverse cross-section of the lower zone of said radiator.
Figure 4:
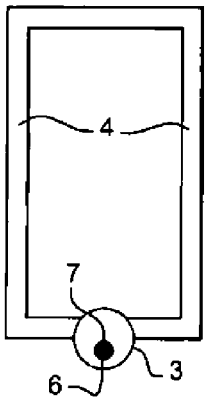
FIG. 4 is an illustration of one alternative of the invention.
Figure 5:
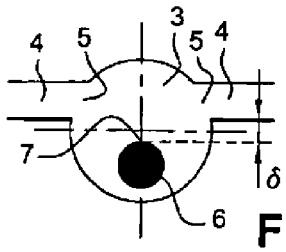
FIGS. 5 and 6 are diagrammatic views in cross-section illustrating one of the inventive features.
Figure 6:
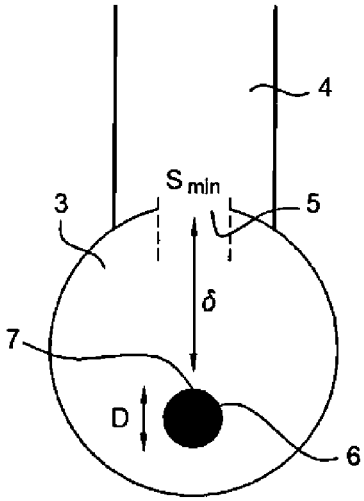

The operating mode of a radiator of this kind has been shown in FIG. 3. The upward-pointing arrows show the vaporization and then the rise of the heat-transfer fluid in vapour phase in the heater, and the downward-pointing arrows show said fluid then condensed in contact with the lateral walls of the channel 4 under consideration, dropping back down in liquid form and by gravity alone into the reservoir 3 through the connection zone 5.

It can be seen that because an electrical resistance 6 is used, the operation of a radiator of this kind can be controlled much more efficiently and instantaneously unlike the prior art devices previously described.

Furthermore the electrical resistance 6 is designed such that the thermal flux density at the surface thereof does not exceed 3 watts per $cm^2$ in order to vaporize the heat-transfer liquid in the form of little bubbles and consequently with a view to reducing the noise effect conventionally generated in radiators with a heat-transfer fluid. Typically, for a radiator of 1.000 watts electric, the surface of the heating strip or electrical resistance 6 in contact with the heat-transfer fluid must be more than 330 $cm^2$, however many channels there are and whatever heat-transfer fluid is used.

According to one inventive feature, the connection zone 5 of the channels 4 at the reservoir 3 emerges above the maximum upper tangency line 7 of said heating strip 6 by a distance 6 of more than or equal to 0.5×D, D being the diameter of the heating strip or electrical resistance 6.

Indeed, the vapour has to be able to flow towards the heater, and the connection zone must not therefore be drowned.

According to another inventive feature, the filling factor α of the radiator is more than 0.0142, the factor α being defined by the following relation:

$$a = \frac{\text{vapour mass at 20° C.}}{\text{total fluid mass}}$$

The vapour mass at 20° C. is determined by the following expression:

$$\text{vapour mass at } 20^\circ \text{ C.} = \frac{V_R - \upsilon_l M}{\upsilon_v - \upsilon_l}$$

where:

$V_R$ is the internal volume of the radiator (in $m^3$);

M denotes the total fluid mass introduced into the radiator (in kg);

$\upsilon_v$ denotes the specific volume per unit mass of the saturated vapour at 20° C. (in $m^3$/kg);

and $\upsilon_l$ denotes the specific volume per unit mass of the saturated liquid at 20° C. (in $m^3$/kg).

Thus, for a radiator having an internal volume of 4 litres (0.004 $m^3$), and for 200 ml of fluid introduced, the following values are obtained:

for HFE 7100®:
M=0.299 kg
$\upsilon_l$=0.00067 $m^3$/kg
$\upsilon_v$=0.428 $m^3$/kg
vapour mass: 0.0089 kg
α=0.0299 for HFE 7300®:
M=0.332 kg
υ=0.00060 $m^3$/kg
vapour mass: 0.0088 kg
α=0.026 for HFE 7500®:
M=0.322 kg
$\upsilon_l$=0.00062 $m^3$/kg
vapour mass: 0.0089 kg
α=0.027 for ZT-85®:
M=0.324 kg
$\upsilon_l$=0.00062 $m^3$/kg
vapour mass: 0.0088 kg
α=0.027 for ZT-130®:
M=0.330 kg
$\upsilon_l$=0.0006 $m^3$/kg
vapour mass: 0.0088 kg
α=0.026 for ZT-150®:
M=0.334 kg
$\upsilon_l$=0.00059 $m^3$/kg
vapour mass: 0.0089 kg
α=0.027 for water:
M=0.199 kg
$\upsilon_l$=0.001 $m^3$/kg
$\upsilon_v$=57.8 $m^3$/kg
vapour mass: 0.000065 kg
α=0.0003 for ethanol
M=0.158 kg
$\upsilon_l$=0.00126 $m^3$/kg
$\upsilon_v$=9.07 $m^3$/kg
vapour mass: 0.0004 kg
α=0.0026

Good radiator operation in respect of the noise problem is seen if the filling factor α is greater than 0.0142.

This criterion is respected if at most 400 ml of HFE 7100®, 5 ml of water or 39 ml of ethanol are introduced into a radiator with an internal volume of 4 litres.

However, in such conditions, only HFE 7100® meets both the thermal efficiency and the sound level objectives.

The inventive radiator therefore makes it possible to overcome the different drawbacks mentioned in relation to prior art radiators in a straightforward and efficient manner and further allows the operation of a radiator of this kind to be controlled more easily.

A radiator has been described that uses a heat-transfer fluid comprising a single type of liquid.

Nonetheless according to the invention, the heat-transfer fluid is constituted by at least two heat-transfer liquids, preferably miscible ones, having boiling points differing by at least 10° C., and preferably 20° C., and more specifically a mixture of at least two types of fluorinated, or hydrofluorinated, aliphatic chains, and particularly two types of hydrofluorethers taken from the group including HFE 7100®, HFE 7300®, HFE 7500®, ZT-150®, ZT-130® and ZT-85®.

A mixture is preferred that comprises from 70% to 95% by volume of the heat-transfer fluid, when the temperature of said fluid is 20° C., having the lowest boiling point, this low boiling point being preferably close to 60° C., and particularly:

a mixture of 67% HFE 7100® and 33% HFE 7300® (hereinafter "mixture 1");

a mixture of 95% HFE 7100® and 5% HFE 7300® (hereinafter "mixture 2");

a mixture of 90% HFE 7100® and 10% ZT-130® (hereinafter "mixture 3"); or a mixture of 85% HFE 7100®, 10% HFE 7300®, and 5% ZT-130® (hereinafter "mixture 4").

The product ZT-130® is deemed to match the formula II below:

$$HF_2C—OC_2F_4)_m—(OCF_2)_n—OCF_2H$$

wherein m and n are natural numbers with 0≤m≤3 and 0≤n≤3.

The particular effect of such a mixture is, comparative to a heat-transfer fluid constituted by a single heat-transfer liquid:

to lower the vapour pressure in the radiator;

to obtain a more homogeneous temperature of the heater 7; and to provide a minimum level of liquid in the lower reservoir 3 in which the heating element 6 is found because a denser and less volatile liquid is present in the heat-transfer fluid, which makes it possible to avoid drying effects in the heating element 6.

So for example, for the heat-transfer fluid constituted by the binary mixture 2 of 95% HFE 7100® and 5% HFE 7300®, there is obtained:

a difference in temperature between the hottest point and the coldest point of the heater 7 of less than 0.6° C., when the heating element 6 operates at its nominal power Qn (maximum authorized operating power when the radiator is in use);

a difference in temperature between the hottest point and the coldest point of the heater 7 of less than 0.3° C., when the heating element 6 operates at 1.24 times its nominal power Qn (Qn' =1.24*Qn is commonly the power at which vapour pressure tests are conducted to find out if the radiator is capable of withstanding same);

a drop in the vapour pressure of 40 mbar relative to a reference heat-transfer fluid commonly used in prior art radiators, and particularly HFE 7100®, when the heating element 6 operates at its nominal power Qn; and a drop in the vapour pressure of 60 mbar relative to the reference heat-transfer fluid, when the heating element 6 operates at 1.24 times its nominal power Qn.

For the heat-transfer fluid constituted by the ternary mixture 4 of 85% HFE 7100®, 10% HFE 7300®, and 5% ZT-130®, there is obtained:

- a difference in temperature between the hottest point and the coldest point of the heater 7 of less than 2.1° C., when the heating element 6 operates at its nominal power Qn;
- a difference in temperature between the hottest point and the coldest point of the heater 7 of less than 1.8° C., when the heating element 6 operates at 1.24 times its nominal power Qn;
- a drop in the vapour pressure of 210 mbar relative to the reference heat-transfer fluid, when the heating element 6 operates at its nominal power Qn; and
- a drop in the vapour pressure of 390 mbar relative to the reference heat-transfer fluid, when the heating element 6 operates at 1.24 times its nominal power Qn.

It may thus be observed that the above mixtures enable a reduction in the operating pressure relative to the reference fluid, while providing the radiator with good temperature homogeneity since the maximum observed temperature difference is less than 5° C. It will also be noted that mixture 2 provides better temperature homogeneity while mixture 4 allows a more substantial reduction in the operating pressure of the radiator. Thus, since the mechanical design pressure of the radiator is equal to twice the vapour pressure obtained at 1.24 times the nominal power Qn, it may be deduced that mechanical stress is reduced by nearly 800 mbar when mixture 4 is used as against 120 mbar when mixture 2 is used.

Clearly the radiator, and more specifically the cross-section S of these channels, the distance δ and the filling factor α are selected as a function of the mixture under consideration, in a manner similar to that described above.

What is claimed is:

1. A radiator for domestic heating with a heat-transfer fluid operating in two-phase form, said heat-transfer fluid comprising a mixture of at least two different heat-transfer liquids, said radiator comprising:

a reservoir of said heat-transfer fluid;

a heating element intended to raise the temperature of said heat-transfer fluid to a temperature such that it causes said fluid to undergo a change of phase from liquid to vapor;

a heater for transferring heat from said heat-transfer vapor to ambient air having at least one channel, at which the heat transfer with the ambient air takes place, communicating in a lower zone with the reservoir, each of the at least one channels being closed at an upper end thereof such that all the heat-transfer vapor that flows upward in each channel undergoes condensation in said channel by transferring heat to ambient air through a wall of said channel, and the heat-transfer liquid resulting from condensation on the wall of said channel also flows downward in the same channel, and wherein said heat-transfer liquids have between them boiling points differing by at least ten degrees Celsius, and wherein the liquid with the lowest boiling point represents 70% to 95% of the volume of the mixture for a mixture temperature of about 20° C.

2. The radiator for domestic heating with a heat-transfer fluid of claim 1, wherein the heating element comprises an electrical resistance heating element.

3. The radiator for domestic heating with a heat-transfer fluid of claim 2, wherein connection zones of the channels are disposed in the vicinity of the reservoir and above the electrical resistance heating element.

4. The radiator for domestic heating with a heat-transfer fluid of claim 3, wherein a distance δ separating a lower end of the connection zones and an upper tangency line of the electrical resistance heating element satisfies the expression $$\delta \geq 0.5 \times D,$$

an expression wherein D denotes a diameter of said electrical resistance heating element.

5. The radiator for domestic heating with a heat-transfer fluid of claim 2, wherein a cross-section S of connection zones separating the reservoir of the heat-transfer fluid and the channels comprising the heater, is greater than or equal to the expression:

$$\frac{A \times P^{\frac{4}{5}}}{n}$$

an expression wherein:

P denotes power of the electrical resistance heating element, and

A is a constant dependent on the fluid and on the temperature thereof.

6. The radiator for domestic heating with a heat-transfer fluid of claim 1, wherein the heat-transfer fluid is a mixture of at least two types of fluorinated or hydrofluorinated aliphatic chains.

7. The radiator for domestic heating with a heat transfer fluid of claim 6, wherein the heat-transfer fluid is a mixture of hydrofluoroethers.

8. The radiator for domestic heating with a heat-transfer fluid of in claim 1, wherein the at least two heat-transfer liquids are miscible with each other.

9. The radiator for domestic heating with a heat-transfer fluid of claim 1, wherein the heat-transfer fluid comprises two different heat-transfer liquids, the first liquid being methoxynonafluorobutane, and the second liquid being decafluoro-3-methoxy-4-trifluoro-methylpentane, and wherein the heat-transfer liquid with the lowest boiling point constitutes about 95% of the volume of the mixture for a mixture temperature equal to 20° C.

10. The radiator for domestic heating with a heat-transfer fluid of claim 1, wherein the heat-transfer fluid is a mixture of three different heat-transfer liquids, the first liquid being methoxynonafluorobutane, the second liquid being decafluoro-3-methoxy-4-trifluoro-methylpentane, and the third liquid being a product that satisfies the formula $HF_2C—(OC_2F_4)_m—(OCF_2)_n—OCF_2H$, wherein m and n are natural numbers with $0 \leq m \leq 3$ and $0 \leq n \leq 3$,; and wherein the first, second and third liquids represent about 85%, 10% and 5% respectively of the volume of the mixture for a mixture temperature equal to 20° C.

11. The radiator for domestic heating with a heat-transfer fluid of claim 1, wherein a filling factor α, defined as being a ratio of vapour mass of the heat-transfer fluid produced at 20 ° C. to a total mass of said fluid introduced into a body of the radiator, satisfies the following relation:

$$\alpha > 0.0142.$$

12. The radiator for domestic heating with a heat transfer fluid of claim 1, wherein the at least one channel consists of a single channel.

13. A radiator for domestic heating with a heat-transfer fluid operating in two-phase form, said heat-transfer fluid being constituted by a mixture of at least two different heat-transfer liquids, comprising:

a reservoir of said heat-transfer fluid;

an electrical resistance heating element intended to raise the temperature of said heat-transfer fluid to a temperature such that it causes said fluid to undergo a change of phase;

a heater, at which the heat transfer with the ambient air takes place, having at least one channel, communicating in a lower zone with the reservoir, each of the at least one channel being closed at an upper end thereof such that all the heat-transfer fluid that flows upward in each channel also flows downward in the same channel, and wherein said heat-transfer liquids have between them boiling points differing by at least ten degrees Celsius, and in that the liquid with the lowest boiling point represents 70% to 95% of the volume of the mixture for a mixture temperature of about 20° C., and wherein the cross-section S of the connection zones separating the reservoir of the heat-transfer fluid and the channels constituting the heater, is greater than or equal to the expression:

$$\frac{A \times P^{\frac{4}{5}}}{n}$$

an expression wherein:

P denotes the power of the electrical resistance heating element, and

A is a constant dependent on the fluid and on the temperature thereof.

14. A radiator for domestic heating with a heat-transfer fluid operating in two-phase form, said heat-transfer fluid being constituted by a mixture of at least two different heat-transfer liquids, said radiator comprising:

a reservoir of said heat-transfer fluid;

an electrical resistance heating element intended to raise the temperature of said heat-transfer fluid to a temperature such that it causes said fluid to undergo a change of phase from liquid to vapor;

a heater, at which the heat transfer with the ambient air takes place, having at least one channel, communicating in a lower zone with the reservoir, each of the at least one channel being closed at an upper end thereof such that all the heat-transfer fluid that flows upward in each channel also flows downward in the same channel, and wherein said heat-transfer liquids have between them boiling points differing by at least ten degrees Celsius, and in that the liquid with the lowest boiling point represents 70% to 95% of the volume of the mixture for a mixture temperature of about 20° C., and wherein said mixture is configured so that the vapour formation phase is implemented in at least two consecutive steps as the temperature of the heating element increases.

* * * * *